US007855510B2

(12) United States Patent
Ohmura et al.

(10) Patent No.: US 7,855,510 B2
(45) Date of Patent: Dec. 21, 2010

(54) PHOTOMULTIPLIER TUBE

(75) Inventors: Takayuki Ohmura, Hamamatsu (JP); Suenori Kimura, Hamamatsu (JP); Masuo Ito, Hamamatsu (JP)

(73) Assignee: Hamamatsu Photonics K.K., Hamamatsu-shi (JP)

( * ) Notice: Subject to any disclaimer, the term of this patent is extended or adjusted under 35 U.S.C. 154(b) by 905 days.

(21) Appl. No.: 10/585,355

(22) PCT Filed: Dec. 24, 2004

(86) PCT No.: PCT/JP2004/019342

§ 371 (c)(1),
(2), (4) Date: Jul. 6, 2006

(87) PCT Pub. No.: WO2005/066999

PCT Pub. Date: Jul. 21, 2005

(65) Prior Publication Data

US 2008/0061690 A1 Mar. 13, 2008

(30) Foreign Application Priority Data

Jan. 8, 2004 (JP) ..... 2004-003037

(51) Int. Cl.
*H01J 43/18* (2006.01)

(52) U.S. Cl. ..... 313/533; 313/532; 313/534; 313/103 R

(58) Field of Classification Search ..... 313/532–544, 313/103 R, 104, 105 R, 105 CM; 250/207, 250/216, 226, 324; 357/9, 18, 301
See application file for complete search history.

(56) References Cited

U.S. PATENT DOCUMENTS

| | | | |
|---|---|---|---|
| 3,917,973 | A | 11/1975 | Needle et al. |
| 4,431,943 | A | 2/1984 | Faulkner et al. |
| 5,616,987 | A | 4/1997 | Ohmura et al. |
| 2003/0132370 | A1 | 7/2003 | Kimura et al. |

FOREIGN PATENT DOCUMENTS

| | | |
|---|---|---|
| EP | 0 539 229 B1 | 3/1996 |
| EP | 0 713 243 A1 | 5/1996 |

(Continued)

OTHER PUBLICATIONS

Dec. 8, 2009 Office Action issued in Japanese Patent Application No. 2004-003037 with English-language translation.

*Primary Examiner*—Bumsuk Won
*Assistant Examiner*—Elmito Breval
(74) *Attorney, Agent, or Firm*—Oliff & Berridge, PLC

(57) ABSTRACT

A photomultiplier tube includes: a cathode, a plurality of dynodes, and an electron lens forming electrode. The cathode emits electrons in response to incident light. The plurality of dynodes multiplies electrons emitted from the cathode. The electron lens forming the electrode is disposed in a prescribed position in relation to an edge of a first dynode positioned in a first stage from the cathode and an edge of a second dynode positioned in a second stage from the cathode, and smoothes an equipotential surface in a space between the first dynode and the second dynode along a longitudinal direction of the first dynode. This structure improves time resolution in response to incident light.

21 Claims, 9 Drawing Sheets

FOREIGN PATENT DOCUMENTS

| | | |
|---|---|---|
| JP | A-43-000443 | 1/1968 |
| JP | A-57-124842 | 8/1982 |
| JP | A-05-114384 | 5/1993 |
| JP | A-08-148114 | 6/1996 |
| JP | A-2002-042719 | 2/2002 |

PHOTOMULTIPLIER TUBE

TECHNICAL FIELD

The present invention relates to a photomultiplier tube for multiplying photoelectrons generated in response to incident light.

BACKGROUND ART

Photomultiplier tubes are used in a wide variety of fields as optical sensors employing the photoelectric effect. External light entering the photomultiplier tube passes through a glass bulb and strikes a photoelectric surface, releasing photoelectrons. The emitted photoelectrons are multiplied by successively impinging on dynodes arranged in a plurality of stages. The multiplied photoelectrons are subsequently collected by an anode as an output signal. External light entering the photomultiplier tube is detected by measuring this output signal (see Patent References 1-3, for example).

Patent Reference 1: Japanese examined patent application publication No. SHO-43-443

Patent Reference 2: Japanese unexamined patent application publication No. HEI-5-114384

Patent Reference 3: Japanese unexamined patent application publication No. HEI-8-148114

DISCLOSURE OF THE INVENTION

Problems to be Solved by the Invention

FIGS. 8 and 9 show an example configuration for this type of photomultiplier tube. These drawings show what is referred to as a head-on type photomultiplier tube that includes a hermetically sealed vessel 1 including a cylindrical glass bulb and accommodating a cathode 3, dynodes 7 arranged in a plurality of stages, and an anode 9.

Light incident on the cathode 3 side endface of the hermetically sealed vessel 1 passes through the endface and strikes a photoelectric surface of the cathode 3, releasing photoelectrons from the cathode 3. The emitted photoelectrons are converged onto a first dynode 7*a* by a focusing electrode 5. The converged photoelectrons are multiplied by sequentially impinging on multiple stages of dynodes 7*a*, 7*b*, and 7*c*, and the multiplied photoelectrons are collected by the anode 9 as an output signal. In order to multiply the photoelectrons efficiently, the dynodes 7*a*, 7*b* and 7*c* are formed as convex parts pointing toward the dynode in the subsequent stage and have side walls on the ends.

In the photomultiplier tube described above, the shape of the first dynode 7*a* causes distortion in the potential distribution along a longitudinal direction near the first dynode 7*a* (distribution of equipotential lines L0) so that the strength of the electric field on ends of the first dynode 7*a* near side walls 11 is less than that in the center of the first dynode 7*a* (see FIG. 9(*a*)). Photoelectrons emitted from a peripheral part of the cathode 3 impinge on the first dynode 7*a* near the ends thereof (photoelectron path f0). Due to the nonuniform electric field near the first dynode 7*a*, photoelectrons multiplied after impingement near the end of the first dynode 7*a* follow a path that bends from the side wall 11 side toward the axis of the hermetically sealed vessel 1 before impinging on the second dynode 7*b*.

Photoelectrons emitted from the center region of the cathode 3, on the other hand, impinge on the first dynode 7*a* near the center thereof, are multiplied by the first dynode 7*a*, and follow a substantially straight line to the second dynode 7*b* (photoelectron path g0). Therefore, a cathode transit time difference (CTTD) is produced among photoelectrons according to the positions of incident light on the cathode 3, leading to such problems as irregularities in the output signal response to the incident light and difficulty in obtaining sufficient time resolution in the output signal.

In view of the foregoing, it is an object of the present invention to improve the time resolution for incident light on a photomultiplier tube.

Means for Solving the Problems

The present invention provides a photomultiplier tube includes: a cathode, a plurality of dynodes, and potential regulating means. The cathode emits electrons in response to incident light. The plurality of dynodes multiplies electrons emitted from the cathode. The potential regulating means is disposed in a prescribed position in relation to an edge of a first dynode positioned in a first stage from the cathode and an edge of a second dynode positioned in a second stage from the cathode, and smoothes an equipotential surface in a space between the first dynode and the second dynode along a longitudinal direction of the first dynode.

With this construction, the potential distribution is flattened in the longitudinal direction of the first dynode in front of the first dynode. As a result, photoelectrons emitted from the peripheral edge of the cathode travel substantially in a straight line from the first dynode after being multiplied at the edge of the first dinode to impinge on the second dynode. Since this structure reduces deviation in the transit distance of photoelectrons based on the irradiated position of light on the cathode.

It is preferable that the potential regulating means is a plate-shaped electron lens forming electrode disposed between the edge of the first dynode and the edge of the second dynode and arranged substantially parallel to a side wall of the first dynode and separated from the first dynode. A voltage is applied to the electron lens forming electrode to produce a higher potential than the potential of the first dynode.

With this construction, the electron lens forming electrode effectively increases the potential in the space from the edge of the first dynode to the edge of the second dynode, facilitating the smoothing of the potential distribution.

It is preferable that the electron lens forming electrode is electrically connected to an edge of a third dynode positioned in a third stage from the cathode.

In this case, the voltage supplied to the electron lens forming electrode can be shared with the third dynode, facilitating adjustment of the potential distribution.

It is also preferable that the electron lens forming electrode is separated from the plurality of dynodes.

With this construction, the electron lens forming electrode insulates from the dynodes. Thus, power can be supplied to the electron lens forming electrode independently, enabling the power to be regulated as desired for potential distribution.

It is preferable that the photomultiplier tube further includes a second electron lens forming electrode disposed between an edge of the second dynode and an edge of the third dynode and arranged substantially parallel to the electron lens forming electrode and separated from the second dynode. A voltage is applied to the second electron lens forming electrode to produce a higher potential than the potential in the second dynode.

By providing this second electron lens forming electrode to smooth the potential distribution at the front side of the second dynode along the longitudinal direction of the second dynode, it is possible to further reduce deviation in the transit distance of photoelectrons relative to the irradiated position of light on the cathode.

According to the above configuration, it is preferable that the second electron lens forming electrode is integrally formed with the electron lens forming electrode.

By forming the electron lens forming electrodes integrally in this way so that voltage supplied to the electrodes can be shared, the electrodes can implement the function of an electron lens through a simple structure.

It is preferable that the cathode, the dynodes, and the lens forming electrode are disposed in a hermetically sealed vessel that is cylindrical in shape and sealed on both ends. The light enters the hermetically sealed vessel from one end thereof. The dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes. The lens forming electrode forms a fan shape that follows the concave shape of the first dynode when viewed in a cross section along a direction orthogonal to the inner surfaces of the first dynode, second dynode, and third dynode.

Effects of the Invention

The photomultiplier tube according to the present invention sufficiently improves time resolution in response to incident light.

BRIEF DESCRIPTION OF THE DRAWINGS

FIG. 2(*b*) is a view of the endface of the photomultiplier tube in FIG. 1 seen from the left side in FIG. 1.

FIG. 9(*b*) is a cross-sectional view of the photomultiplier tube in FIG. 8 seen from the left.

DESCRIPTION OF THE REFERENCE NUMERALS

Figure 1:
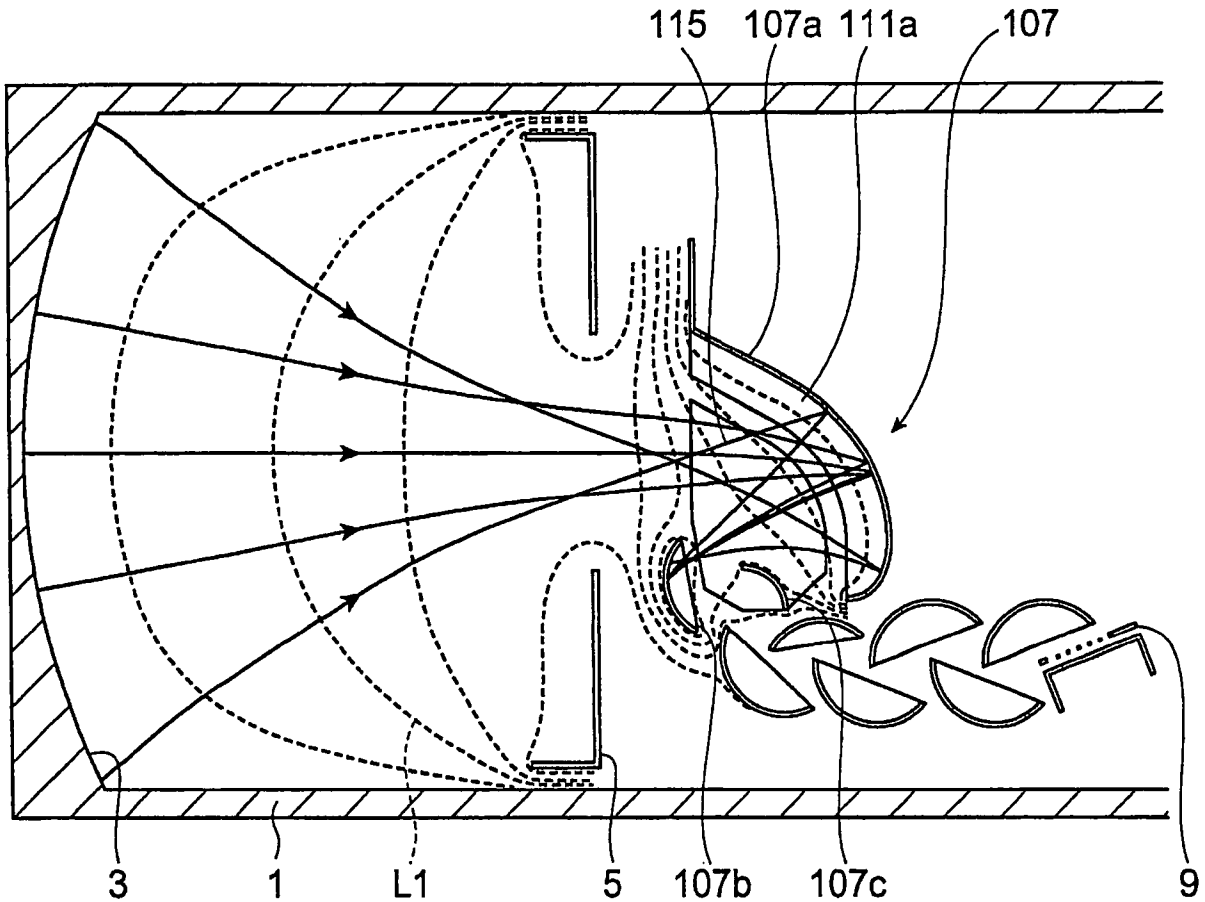
FIG. 1 is a vertical cross-sectional view of a photomultiplier tube according to a first embodiment of the present invention taken orthogonal to the longitudinal direction of dynodes in the photomultiplier tube.

1: hermetically sealed vessel; 3: cathode; 5: focusing electrode; 7, 7*a*, 7*b*, 7*c*, 107, 107*a*, 107*b*, 107*c*: dynodes; 9: anode; 11, 111*a*, 111*b*, 113*a*, 113*b*: side walls; 115, 117, 215, 315, 319, 323: electron lens forming electrodes; 319: electron lens forming electrode (second electron lens forming electrode).

Best Mode for Carrying out the Invention

Next, preferred embodiments for a photomultiplier tube according to the present invention will be described in detail while referring to the accompanying drawings. In the drawings, like parts and components with those in the conventional structure described above will be designated with the same reference numerals. Further, directions up, down, left, and right in the following description will conform to up, down, left, and right in the drawings.

First Embodiment

Figure 2A:
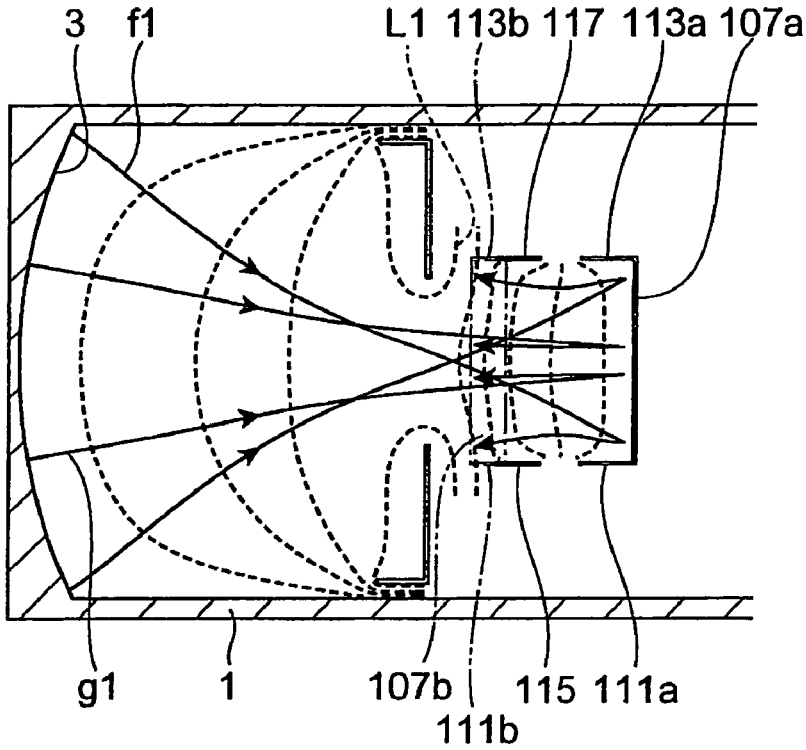
FIG. 2(*a*) is a view of an endface of the photomultiplier tube in FIG. 1 along the longitudinal direction of a dynode.
Figure 2B:
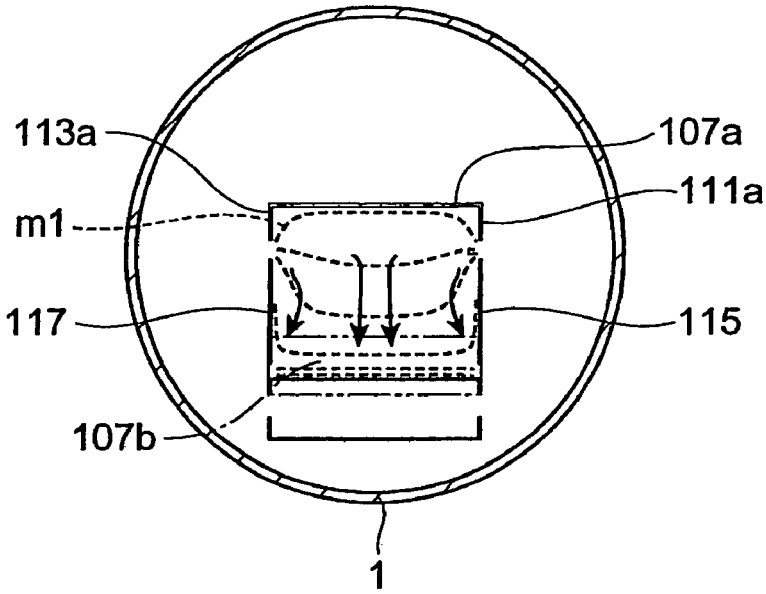

FIG. 1 is a vertical cross-sectional view of a photomultiplier tube according to a first embodiment of the present invention taken orthogonal to the longitudinal direction of dynodes in the photomultiplier tube. FIG. 2(*a*) is a view of an endface of the photomultiplier tube in FIG. 1 along the longitudinal direction of the dynodes. FIG. 2(*b*) is a view of the endface of the photomultiplier tube in FIG. 1 from the left side in the drawing. The photomultiplier tube of the preferred embodiment is a head-on type photomultiplier tube for detecting light incident on an endface thereof. Hereinafter, "upstream side" will refer to the side of the endface on which light is incident, and the "downstream side" will refer to the opposite side of the "upstream side".

A hermetically sealed vessel 1 shown in FIG. 1 is transparent and, more specifically, is a transparent cylindrical glass bulb sealed on both upstream side and downstream side ends. A cathode 3 configured of a transmissive photoelectric cathode is provided inside the hermetically sealed vessel 1 near the upstream side endface for emitting photoelectrons in response to incident light. An anode 9 is mounted in the hermetically sealed vessel 1 on the downstream side for extracting, in the form of an output signal, photoelectrons that travel downstream while being multiplied. A focusing electrode 5 is disposed between the cathode 3 and the anode 9 for converging the photoelectrons emitted from the cathode 3 in the axial direction. Dynodes 107 are arranged in a plurality of stages downstream of the focusing electrode for multiplying the converged photoelectrons. Voltages are supplied for maintaining each of the cathode 3, focusing electrode 5, dynodes 107, and anode 9 at prescribed potentials. These voltages are supplied from a power supply via a power supply circuit (not shown in the drawings), such as a voltage dividing circuit. In this case, the power supply circuit may be formed integrally with or separately from the photomultiplier tube.

Figure 3:
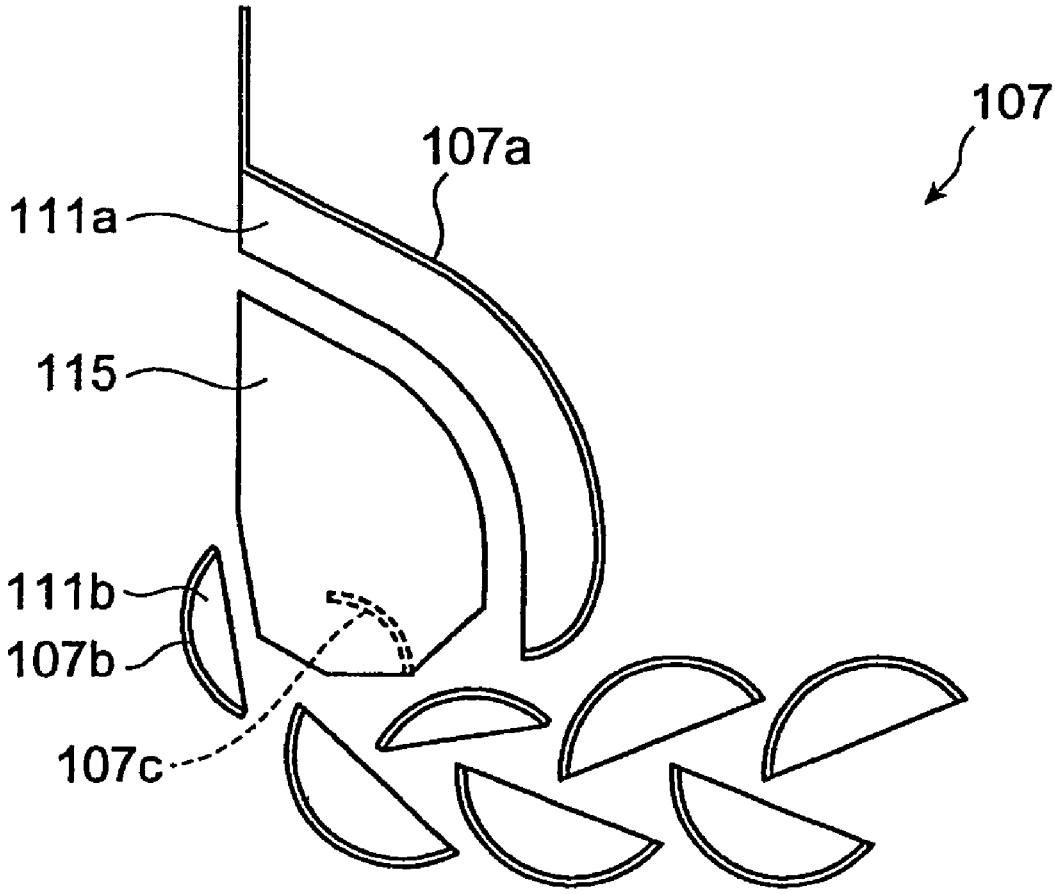
FIG. 3 is a side view showing the dynodes in FIG. 1.

FIG. 3 is a side view of the dynodes 107 when seen in the same direction as in FIG. 1. As shown in FIG. 3, dynodes 107*a*, 107*b*, and 107*c* are positioned in a first stage, second stage, and third stage, respectively from the cathode 3. A longitudinal direction of the dynodes is a direction orthogonal to the surface of the drawing. The dynodes 107*a*, 107*b*, and 107*c* are formed in a prescribed concave shape facing toward the dynode in the next stage and are positioned at a prescribed inclination angle for efficiently multiplying photoelectrons released from the cathode 3 and the dynodes of previous stages. As shown in FIG. 2(*a*), side walls 111*a* and 113*a* are provided on both longitudinal ends (upper and lower ends in FIG. 2(*a*)) of the first dynode 107*a*. The side walls 111*a* and 113*a* extend from the ends of the first dynode 107*a* toward the second dynode 107*b* in a direction orthogonal to the longitudinal direction. Similarly, side walls 111*b* and 113*b* are formed on both ends of the second dynode 107*b*. FIGS. 2(*a*) and 2(*b*) indicate the position of the second dynode 107*b* with a broken line having alternating solid lines and double dots. The structure of the dynodes in the fourth and lower stages is identical to that of the second dynode 107*b* and, hence, a description of this structure will not be repeated.

The power supply circuit described above is also connected to the dynodes 107*a*, 107*b*, and 107*c* and supplies a voltage for maintaining these dynodes at respective prescribed potentials VA, VB, and VC (VA<VB<VC). Voltages are supplied to the remaining dynodes in the same way so that the potential becomes progressively greater toward the anode 9.

Electron lens forming electrodes (potential regulating means) 115 and 117 are disposed between the side walls 111*a* and 113*a* of the first dynode 107*a* and the side walls 111*b* and 113*b* of the second dynode 107*b* so as to be substantially parallel to the side walls 111*a* and 113*a*. The electron lens forming electrodes 115 and 117 are plate electrodes and are substantially fan-shaped so as to cover most of the region interposed between the side walls 111*a* and 113*a* and the side walls 111*b* and 113*b*, as shown in FIG. 3. Another shape may be used for the electron lens forming electrodes 115 and 117, such as an elliptical shape, rectangular shape, or triangular shape, but the fan shape is preferable because this shape efficiently implements an electron lens function between the dynodes 107.

In the preferred embodiment, the electron lens forming electrode 115 is bonded to an edge of the third dynode 107*c* to form an electrical connection therewith. However, the electron lens forming electrode 115 is electrically insulated from the first dynode 107*a* by separating the electron lens forming electrode 115 a prescribed distance from the side wall 111*a*. In fact, the electron lens forming electrode 115 is electrically insulated from all dynodes except the third dynode 107*c*. The structure of the electron lens forming electrode 117 is similar to the electron lens forming electrode 115 described above.

In the preferred embodiment, the electron lens forming electrodes 115 and 117 are bonded to the third dynode 107*c*. However, the electron lens forming electrodes 115 and 117 may be electrically connected to the third dynode 107*c* by another conducting means, such as lead wires or metal.

With this construction, voltage can be applied to the electron lens forming electrodes 115 and 117 at the same time a voltage is applied to the third dynode 107*c*. Specifically, voltage is applied to the electron lens forming electrodes 115 and 117 to generate a potential VC higher than a potential VA in the first dynode 107*a*. FIG. 2(*a*) shows the distribution of equipotential lines L1 from the cathode 3 to the first dynode 107*a*, and FIG. 2(*b*) shows the distribution of equipotential lines ml in a radial direction in the space between the first dynode 107*a* and the second dynode 107*b*. As can be seen in these drawings, there is a relative increase in potential in the space from near the side walls 111*a* and 113*a* of the first dynode 107*a* to near the side walls 111*b* and 113*b* of the second dynode 107*b*. Accordingly, equipotential lines L1 and ml between the dynodes 107*a* and 107*b* are flattened along the longitudinal direction of the first dynode 107*a* (vertically in FIG. 2(*a*) and left-to-right in FIG. 2(*b*)), while the electric field between the dynodes 107*a* and 107*b* becomes uniform along the longitudinal direction of the first dynode 107*a*. This uniformity is particularly striking near the first dynode 107*a*.

Due to the space potential configuration described above, photoelectrons emitted from the upper end of the cathode 3 are incident on the longitudinal end of the first dynode 107*a*, multiplied, and emitted in a direction parallel to the side walls 111*a* and 113*a*, as shown in FIG. 2(*a*). Photoelectrons emitted in this way travel substantially in a straight line and impinge on an end of the second dynode (photoelectron path f1). In contrast, photoelectrons emitted from the center region of the cathode 3 that impinge on a longitudinal center of the first dynode 107*a* are multiplied and emitted in a direction parallel to the side walls 111*a* and 113*a*. Hence, photoelectrons emitted from the first dynode 107*a* in this way travel substantially in a straight path and impinge on the central region of the second dynode (photoelectron path g1).

Therefore, use of the electron lens forming electrodes 115 and 117 flattens the potential distribution in the longitudinal direction of the first dynode 107*a* in front of the first dynode 107*a*, that is, between the dynodes 107*a* and 107*b*. As a result, both photoelectrons emitted from the peripheral edge of the cathode 3 and photoelectrons emitted from the center region of the cathode 3 travel substantially in a straight line from the first dynode 107*a* after being multiplied thereby to impinge on the second dynode 107*b*. Since this structure reduces deviation in the transit distance of photoelectrons based on the irradiated position of light on the cathode 3, the structure also reduces the cathode transit time difference (CTTD) according to the irradiated position of light and a transit time spread (TTS) when light is irradiated on the entire surface. In particular, since the transit distance between the dynodes 107*a* and 107*b* is greater than that between other dynodes, the CTTD and TTS can be effectively reduced by providing the electron lens forming electrodes 115 and 117.

Further, the electron lens forming electrodes 115 and 117 are electrically connected to the third dynode 107*c* and can share the power supply circuit, wiring, and the like of a voltage supplying means used for the third dynode 107*c*. Thus, this structure facilitates the supply of a voltage to the electron lens forming electrodes 115 and 117.

Second Embodiment

Next, a photomultiplier tube according to a second embodiment will be described, wherein like parts and components are designated with the same reference numerals to avoid duplicating description.

Figure 4:
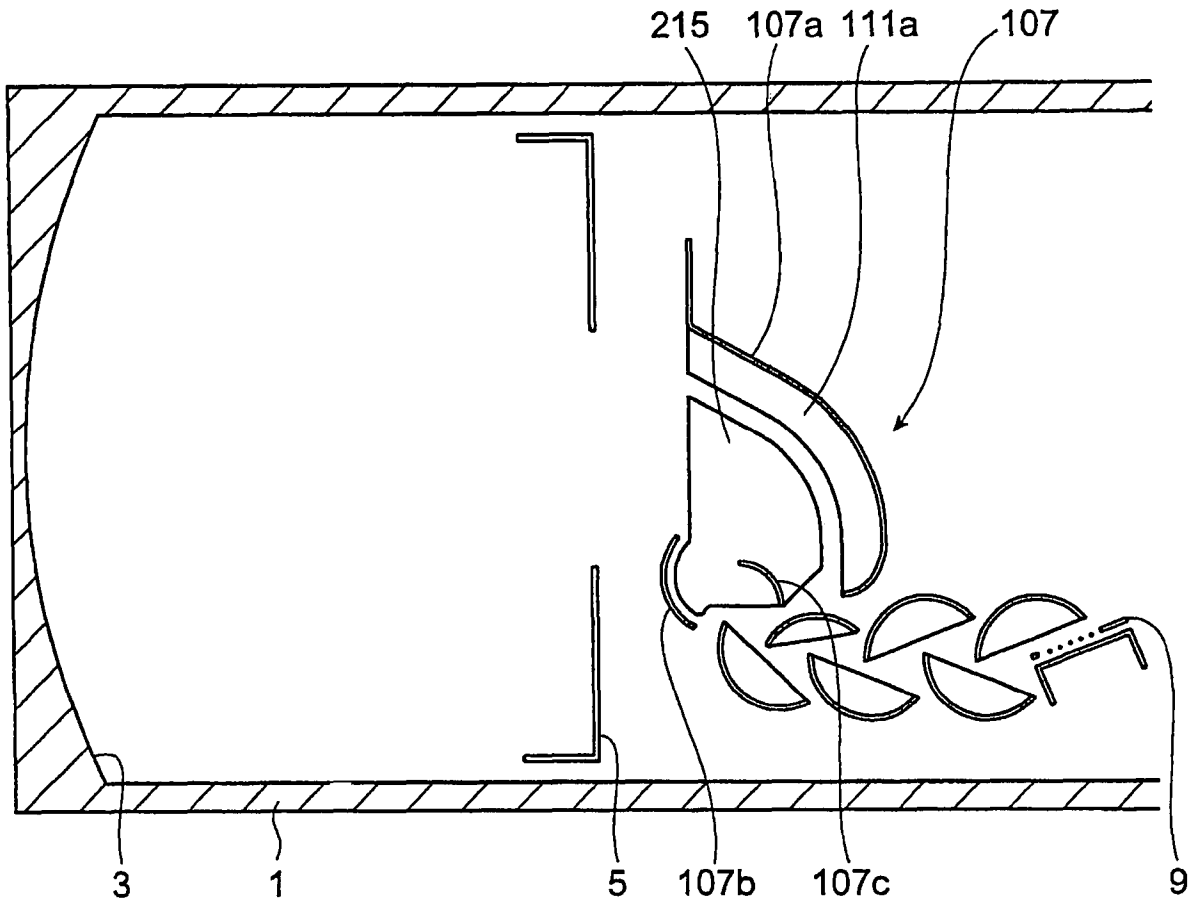
FIG. 4 is a vertical cross-sectional view of a photomultiplier tube according to a second embodiment of the present invention taken orthogonal to the longitudinal direction of dynodes in the photomultiplier tube.

FIG. 4 is a vertical cross-sectional view taken orthogonal the longitudinal direction of dynodes in a photomultiplier tube according to a second embodiment of the present invention. As shown in FIG. 4, the second dynode 107*b* is provided without the side walls on either end.

An electron lens forming electrode 215 is provided between the side wall 111*a* and an edge of the second dynode 107*b* and is substantially parallel to the side wall 111*a*. Here, another electron lens forming electrode is also disposed on the other edge of the second dynode 107*b*. However, the structure of this electron lens forming electrode is identical to the electron lens forming electrode 215 and will not be described here. The electron lens forming electrode 215 is a plate electrode that is substantially fan shaped in a region interposed between the side wall 111*a* and the edge of the second dynode 107*b*, as in the electron lens forming electrode 115 described above. However, the electron lens forming electrode 215 is different from the electron lens forming electrode 115 in that the electron lens forming electrode 215 extends toward the vicinity of the edge of the second dynode

107*b*. Further, the electron lens forming electrode 215 is bonded to the edge of the third dynode 107*c* but is separated from all dynodes other than the third dynode 107*c* so as to be electrically insulated therefrom. By employing this structure, a plate electrode is provided between the edge of the second dynode 107*b* and the edge of the third dynode 107*c* and functions as potential regulating means.

The photomultiplier tube having this structure also flattens the potential distribution in the longitudinal direction of the second dynode 107*b* on the front surface of the 107*b*, that is, between the second dynode 107*b* and the third dynode 107*c*. Hence, the transit time difference of photoelectrons between the second dynode 107*b* and third dynode 107*c* is shortened, thereby further reducing deviation in the overall transit distance of the photoelectrons according to the irradiated position of light on the cathode 3 to further reduce CTTD and TTS.

Third Embodiment

Next, a photomultiplier tube according to a third embodiment will be described, wherein like parts and components are designated with the same reference numerals to avoid duplicating description.

Figure 5:
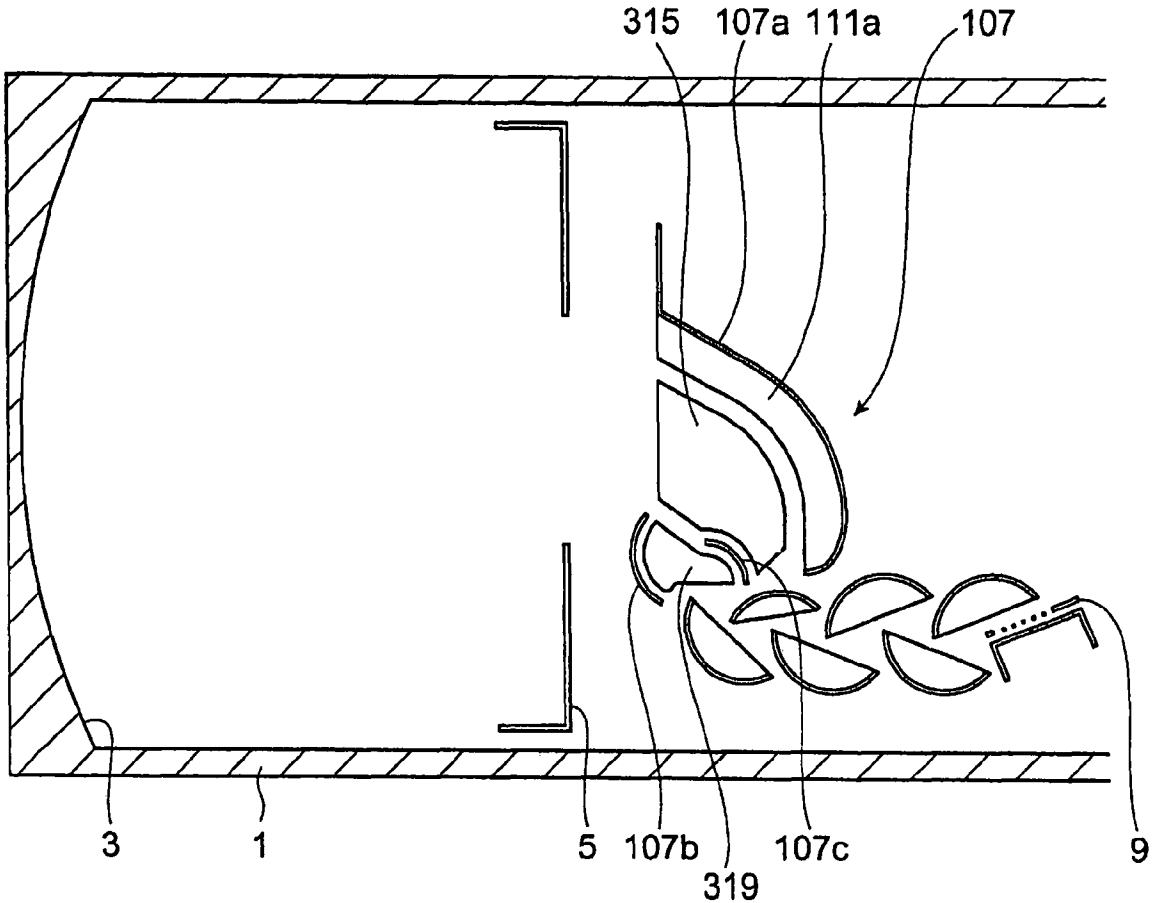
FIG. 5 is a vertical cross-sectional view of a photomultiplier tube according to a third embodiment of the present invention taken orthogonal to the longitudinal direction of dynodes in the photomultiplier tube.

FIG. 5 is a vertical cross-sectional view taken orthogonal to the longitudinal direction of dynodes in a photomultiplier tube according to a third embodiment of the present invention. As shown in FIG. 5, both the second dynode 107*b* and third dynode 107*c* are provided without side walls on either end.

An electron lens forming electrode 315 is disposed between the side wall 111*a* and an edge of the third dynode 107*c* and is substantially parallel to the side wall 111*a*. The shape and position of the electron lens forming electrode 315 is nearly identical to that of the electron lens forming electrode 115. However, the electron lens forming electrode 315 is formed in a fan shape with its narrow end being cut out and is separated a fixed distance from the edge of the third dynode 107*c*. Further, the electron lens forming electrode 315 is separated at least a fixed distance from all dynodes so as to be electrically insulated from the same.

Additionally, an electron lens forming electrode (second electron lens forming electrode) 319 is disposed between an edge of the second dynode 107*b* and an edge of the third dynode 107*c* and runs parallel to the electron lens forming electrode 315. The electron lens forming electrode 319 is substantially fan-shaped so as to cover most of the area interposed between the edge of the second dynode 107*b* and the edge of the third dynode 107*c*. Further, by positioning the electron lens forming electrode 319 at a distance from the edges of the second dynode 107*b* and third dynode 107*c*, the electron lens forming electrode 319 is electrically insulated from all dynodes 107.

Here, electron lens forming electrodes are also provided at the other edge. However, since these electron lens forming electrodes have the same structure as the electron lens forming electrodes 315 and 319, a description has been omitted.

Further, a power supply circuit including a voltage dividing circuit is connected to the electron lens forming electrodes 315 and 319 for supplying a voltage to each electrode. A voltage is applied to the electron lens forming electrode 315 to produce a potential higher than the VA, and a voltage is applied to the electron lens forming electrode 319 to produce a potential higher than the VB.

The photomultiplier tube having this construction can simultaneously flatten the potential distribution in the longitudinal direction of the dynodes in the space between the first dynode 107*a* and second dynode 107*b* and in the space between the second dynode 107*b* and third dynode 107*c*, thereby reducing deviation in the transit distance of photoelectrons according to the irradiated position of light. Further, the potentials of the electron lens forming electrodes 315 and 319 can be adjusted as needed, enhancing the freedom for adjusting the space potential.

The present invention is not limited to the embodiments described above.

Figure 6:
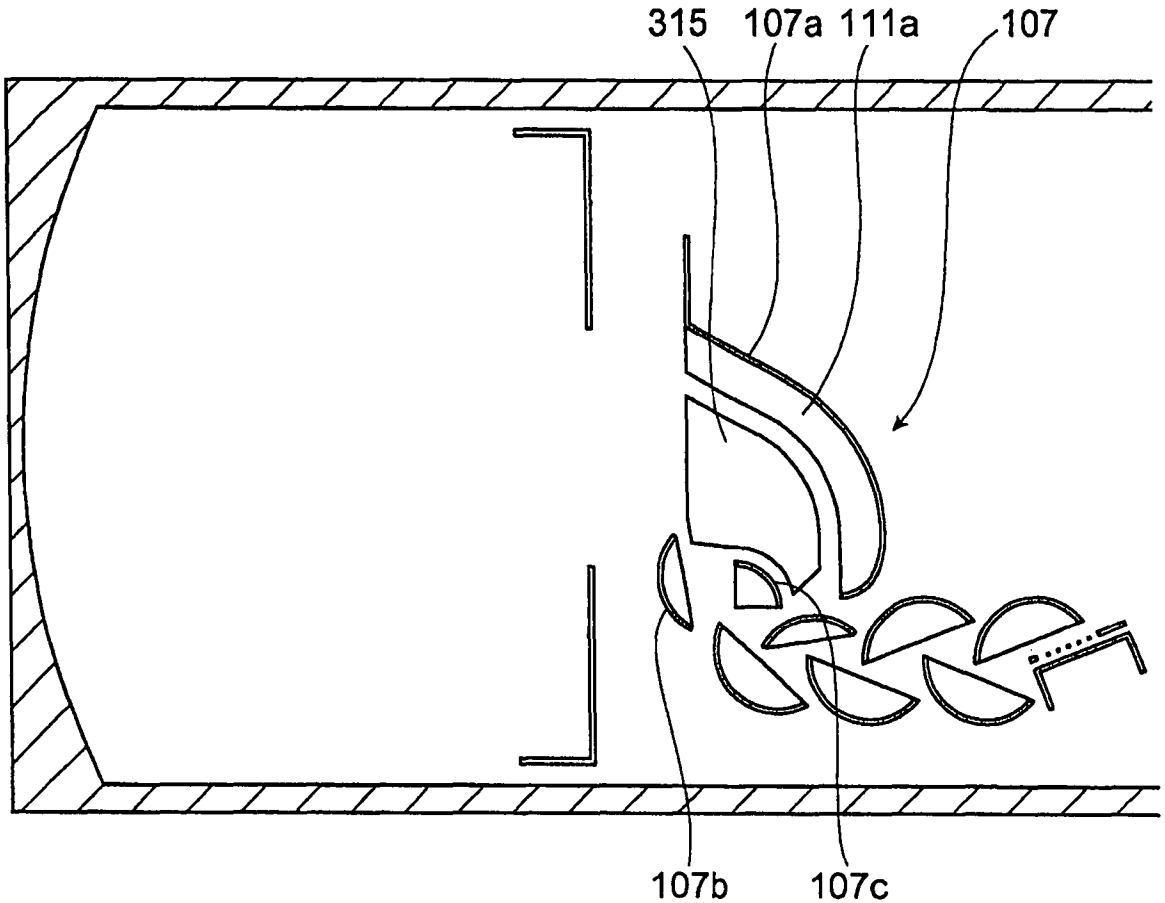
FIG. 6 is a vertical cross-sectional view of a photomultiplier tube according to another embodiment taken orthogonal to the longitudinal direction of dynodes in the photomultiplier tube.

For example, while the photomultiplier tube according to the third embodiment is provided with the electron lens forming electrodes 315 and 319, it is possible to provide only the electron lens forming electrode 315 in this photomultiplier tube, as shown in FIG. 6.

Figure 7:
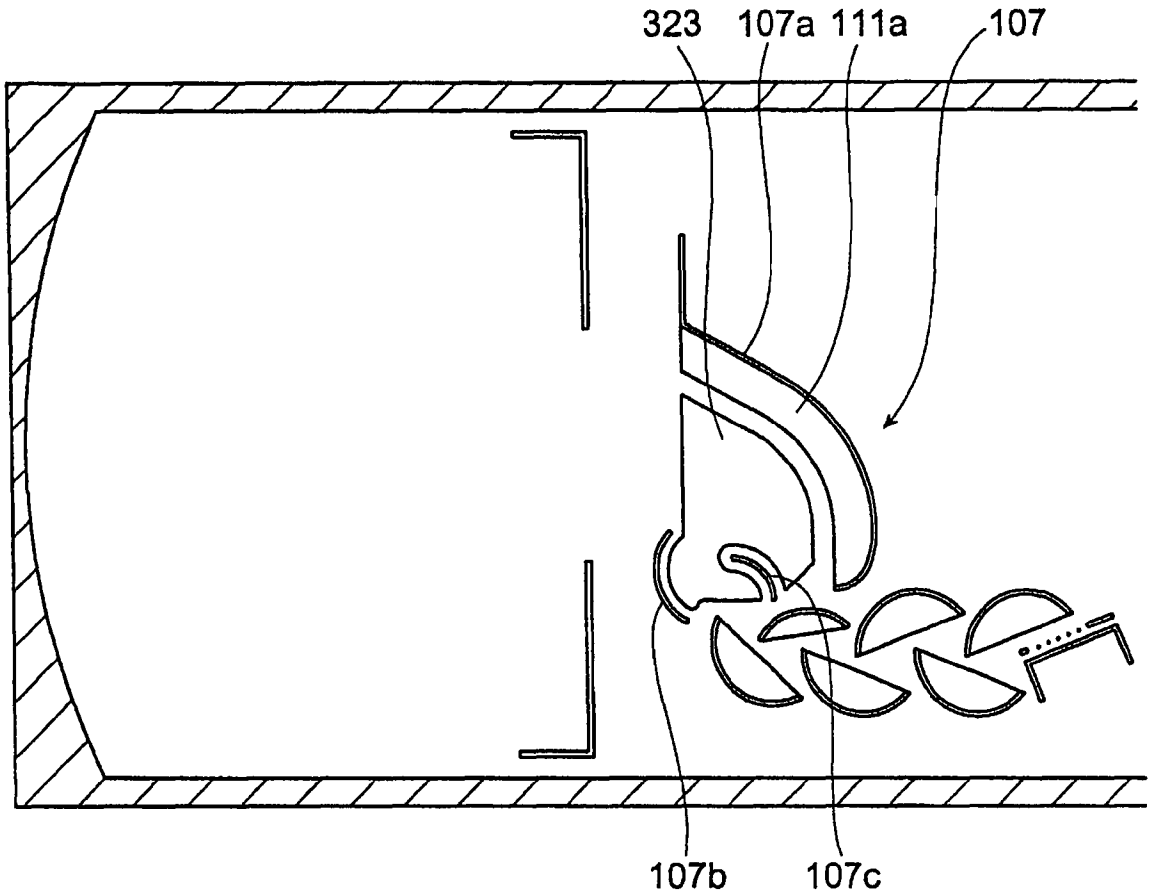
FIG. 7 is a vertical cross-sectional view of a photomultiplier tube according to another embodiment taken orthogonal to the longitudinal direction of dynodes in the photomultiplier tube.
Figure 8:
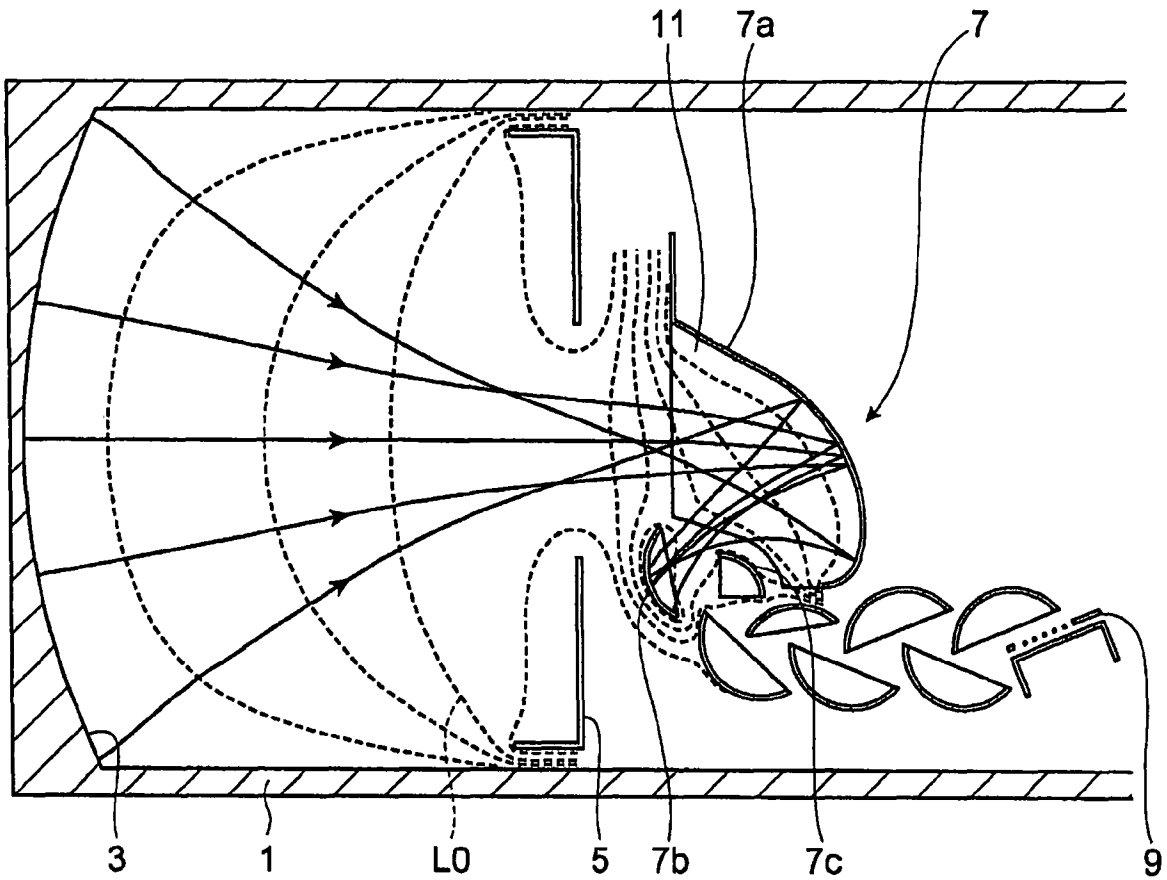
FIG. 8 is a vertical cross-sectional view showing an example of a photomultiplier tube.
Figure 9A:
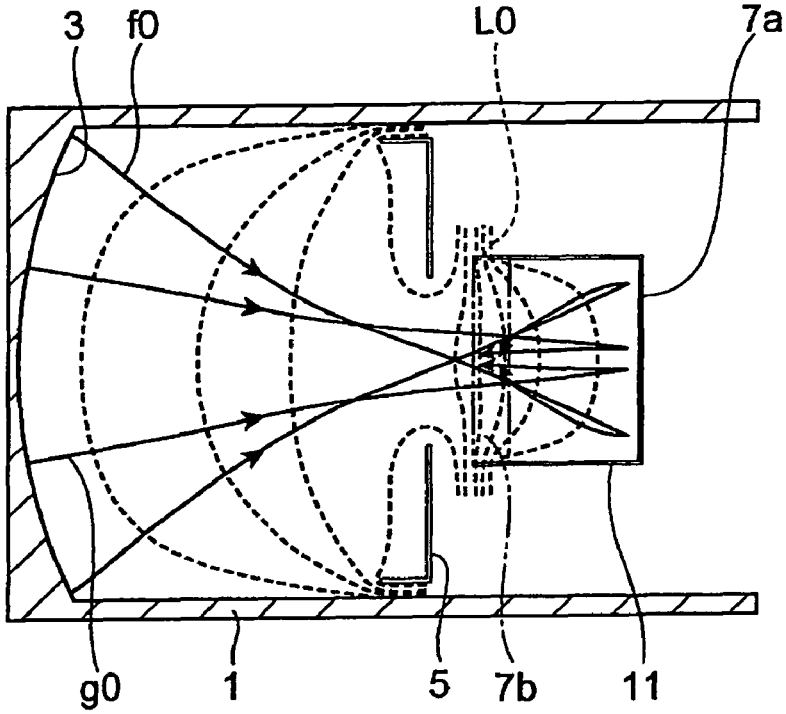
FIG. 9(*a*) is a cross-sectional view of the photomultiplier tube in FIG. 8 seen from the top.
Figure 9B:
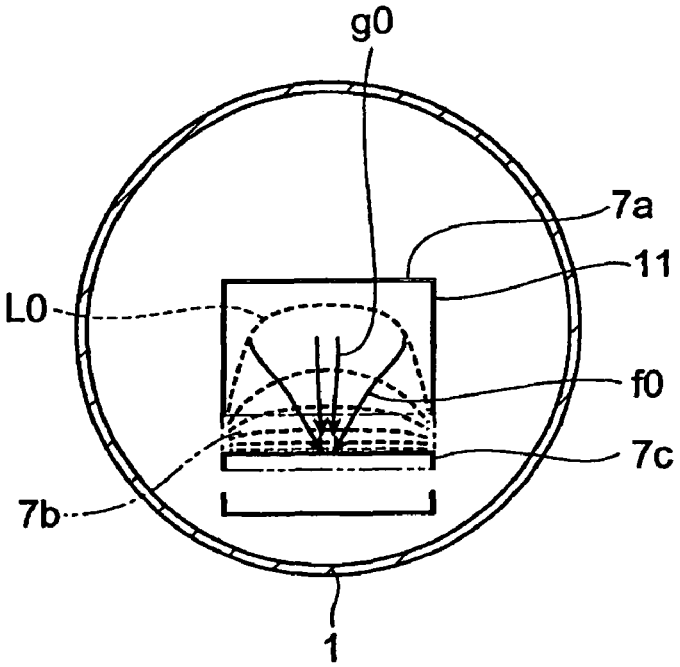

Further, in the photomultiplier tube according to the third embodiment, the electron lens forming electrodes 315 and 319 are spatially independent of each other. However, the electron lens forming electrodes may be formed integrally as an electron lens forming electrode 323, as shown in FIG. 7. The electron lens forming electrode 323 is formed with a depression that enables the electron lens forming electrode 323 to be separated a fixed distance from the third dynode 107*c*. This construction enables the electrodes to share a voltage supplying means and simplifies the overall structure of the device.

INDUSTRIAL APPLICABILITY

The photomultiplier tube of the present invention is particularly useful in fields requiring photomultiplier tubes to obtain sufficient time resolution in the output signal.

What is claimed is:

1. A photomultiplier tube comprising:

a cathode emitting electrons in response to incident light;

a plurality of dynodes multiplying electrons emitted from the cathode, each dynode extending in a prescribed direction, the plurality of dynodes having a first dynode and a second, dynode, the first dynode receiving electrons from the cathode and multiplying the electrons and emitting the multiplied electrons, and the second dynode receiving the electrons from the first dynode and multiplying the electrons and emitting the multiplied electrons, the first dynode having a first end face and a second end face opposite the first end face, the first end face and the second end face extending perpendicularly to the prescribed direction and the second dynode having a first end and a second end; and potential regulating means smoothing an equipotential surface in a space between the first dynode and the second dynode along the prescribed direction, the potential regulating means including a first regulating element and a second regulating element that is separate from the first regulating element, the first regulating element being located between the first end face of the first dynode and the first end of the second dynode in a direction perpendicular to the prescribed direction and the second regulating element being located between the second end face of the first dynode and the second end of the second dynode in the direction perpendicular to the prescribed direction.

2. The photomultiplier tube as claimed in claim 1, wherein each of the first and second regulating elements is a plate-shaped electron lens forming electrode arranged substantially parallel to the first and second end faces and separate from the first dynode; and a voltage is applied to each of the first and second regulating elements to produce a higher potential than the potential of the first dynode.

3. The photomultiplier tube as claimed in claim 2, wherein the plurality of dynodes further have a third dynode having an edge and another edge in the prescribed direction and receiving the electrons from the second dynode and multiplying and emitting the electrons, wherein the first regulating element is electrically connected to the edge of the third ,dynode and the second regulating element is electrically connected to the another edge of the third dynode.

4. The photomultiplier tube as claimed in claim 3, further comprising a third regulating element that is a plate-shaped electron lens forming electrode, that is disposed between the first end of the second dynode and the edge of the third dynode, that is arranged substantially parallel to the first and second regulating elements, and that is separate from the second dynode; and wherein a voltage is applied to the third regulating element to produce a higher potential than the potential in the second dynode.

5. The photomultiplier tube as claimed in claim 4, further comprising:

a fourth regulating element that is a plate-shaped electron lens forming electrode, that is disposed between the second end of the second dynode and the other edge of the third dynode, that is arranged substantially parallel to the first and second regulating elements, and that is separate from the second dynode, wherein the third regulating element is integrally formed with the first regulating element, and the fourth regulating element is integrally formed with the second regulating element.

6. The photomultiplier tube as claimed in claim 5, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

7. The photomultiplier tube as claimed in claim 3, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

8. The photomultiplier tube as claimed in claim 4, wherein the cathode, the dynodes, and the first and second regulating elements are disposed in a hermetically sealed vessel that is cylindrical in shape and sealed on both ends;

the light enters the hermetically sealed vessel from one end thereof;

each of the first and second regulating elements are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and the lens forming electrode forms a fan shape that follows the concave shape of the first dynode when viewed in a cross section along a direction orthogonal to the inner surfaces of the first dynode, second dynode, and third dynode.

9. The photomultiplier tube as claimed in claim 2, wherein the first and second regulating elements are separate from the plurality of dynodes.

10. The photomultiplier tube as claimed in claim 9, further comprising:

a third regulating element that is a plate-shaped electron lens forming electrode, that is disposed between the first end of the second dynode and the edge of the third dynode, that is arranged substantially parallel to the first and second regulating elements, and that is separate from the second dynode; and wherein a voltage is applied to the third regulating element to produce a higher potential than the potential in the second dynode.

11. The photomultiplier tube as claimed in claim 10, further comprising:

a fourth regulating element that is a plate-shaped electron lens forming electrode, that is disposed between the second end of the second dynode and the other edge of the third dynode, that is arranged substantially parallel to the first and second regulating elements, and that is separate from the second dynode, wherein the third regulating element is integrally formed with the first regulating element, and the fourth regulating element is integrally formed with the second regulating element.

12. The photomultiplier tube as claimed in claim 11, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

13. The photomultiplier tube as claimed in claim 9, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

14. The photomultiplier tube as claimed in claim 10, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

15. The photomultiplier tube as claimed in claim 2, further comprising a third regulating element that is a plate-shaped electron lens forming electrode, that is disposed between the first end of the second dynode and the edge of the third dynode, that is arranged substantially parallel to the first and second regulating elements, and that is separate from the second dynode; and wherein a voltage is applied to the third regulating element to produce a higher potential than the potential in the second dynode.

16. The photomultiplier tube as claimed in claim 15, further comprising a fourth regulating element that is a plate-shaped electron lens forming electrode, that is disposed between the second end of the second dynode and the another edge of the third dynode, that is arranged substantially parallel to the first and second regulating elements, and that is separate from the second dynode, wherein the third regulating element is integrally formed with the first regulating element, and the fourth regulating element is integrally formed with the second regulating element.

17. The photomultiplier tube as claimed in claim 16, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

18. The photomultiplier tube as claimed in claim 15, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

19. The photomultiplier tube as claimed in claim 2, wherein the cathode, the dynodes, and the first and second regulating elements are disposed in a hermetically sealed vessel that is cylindrical in shape and sealed on both ends;

the light enters the hermetically sealed vessel from one end thereof;

the dynodes are concave and substantially arc-shaped, the first dynode opening substantially toward the one end of the hermetically sealed vessel, the second dynode opening substantially toward another end of the hermetically sealed vessel, and the third dynode opening substantially toward the one end of the hermetically sealed vessel, and the electrons impinge on and are emitted from inner surfaces of the dynodes; and each of the first and second regulating elements forms a fan shape that follows the concave shape of the first dynode when viewed in a cross section along a direction orthogonal to the inner surfaces of the first dynode, second dynode, and third dynode.

20. The photomultiplier tube as claimed in claim 1, wherein each of first and second regulating elements has a plate-shaped electron lens forming electrodes.

21. The photomultiplier tube as claimed in claim 20, wherein the plate-shaped electron lens forming electrodes face each other.

* * * * *